United States Patent [19]

Freeman et al.

[11] Patent Number: 4,793,891

[45] Date of Patent: Dec. 27, 1988

[54] APPLICATION OF LABELS TO ARTICLES

[75] Inventors: Michael Freeman; Brian Nicholson, both of Essex, United Kingdom

[73] Assignee: John Waddington, PLC., England

[21] Appl. No.: 27,374

[22] Filed: Mar. 18, 1987

[30] Foreign Application Priority Data

Mar. 18, 1986 [GB] United Kingdom ..... 8606629

[51] Int. Cl.[4] ..... B65C 9/02; B65C 9/32

[52] U.S. Cl. ..... 156/476; 156/491; 156/567; 156/568; 156/DIG. 25; 156/DIG. 40; 156/DIG. 42

[58] Field of Search ..... 156/475, 476, 486, 489, 156/490, 491, 567, DIG. 25, DIG. 39, DIG. 40, DIG. 42, DIG. 14, 568

[56] References Cited

U.S. PATENT DOCUMENTS 1,536,837 5/1925 Fredsell ..... 156/490
3,616,092 10/1971 Lavigne ..... 156/566

FOREIGN PATENT DOCUMENTS 871031 6/1961 United Kingdom ..... 156/DIG. 14
927147 5/1963 United Kingdom ..... 156/567

*Primary Examiner*—Michael Wityshyn
*Attorney, Agent, or Firm*—Klauber & Jackson

[57] ABSTRACT

The invention provides that labels are applied to containers. The labels have a pressure sensitive side and they are applied by a machine so as to lie tangentially to the bottle necks. The bottles then move through the machine and as they so move, a camming means which moves with the bottle engages the label and wraps it round the bottle neck. The camming means comprises a pair of arms which operate scissor like but in sequence as the bottles move through the machine.

8 Claims, 2 Drawing Sheets

88
10
42
14
68
42
40
54
86
50
10
64
70
10
62
14
14
49
72
56
66
84
10
76
78
46A
60
70
14
90
44
44A
44B
52
14
58
74
80
48
82
46
46B
10
26
14
92
22
10
14
36
14
34
20

30
10
28
22
32
14
10
24

APPLICATION OF LABELS TO ARTICLES

This invention relates to the application of labels to articles, and particularly concerns the application of labels to articles which are in the nature of containers containing for example liquids such as cosmetics, foodstuffs, condiments or beverages.

Although the invention has application to the containers mentioned, it is to be understood that invention is not to be limited to specific containers or container contents but can be applied to a wide range of articles provided that such articles are of appropriate geometric shape, as will follow from the disclosure herein.

The present invention was conceived arising from a need to apply labels to the necks of bottles, in particular sauce bottles, and in the interests of simplicity reference will be made hereinafter only to the application of labels to the necks of sauce bottles.

The labels in connection with which the invention is to be applied will normally have an adhesive surface on one side thereof, being the side which is applied to the bottle neck, although it should be mentioned that the invention may be applicable where the mechanical inversion applies i.e. where the adhesive is on the bottle neck, and the label is applied thereto, but again in the interests of simplicity of explanation, only the case in which the adhesive is on the label will be discussed and referred to.

Finally, the invention is applicable to a situation in which the bottles whose necks are to be labelled travel in sequence through an applicator machine i.e. the process is automated to ensure high speed and efficient production.

In one known method of applying labels to bottle necks, the adhesive side of the label, by a leading end thereof, is applied to the bottle neck, and then the bottle, whilst it moves through the machine, is caused to rotate so that the label is wiped around the neck surface and adheres thereto. The label may be what is known as a complete wrap round label in which case the trailing end of the label meets or overlaps the leading end when it has been wrapped round the bottle neck, or it may be a patch label which extends only part way around the bottle neck.

This method of applying bottle neck labels is expensive and slow insofar as a means is needed to revolve the bottles, and a finite time is also required to ensure that the bottle effects a complete rotation.

Additionally, the known method typically uses pressure sensitive adhesives which are carried by a release carrier web so that the labels can be peeled from the web and applied to the bottles, but more recently there has been developed technology for cutting individual labels from a roll of backingless self adhesive labels, the labels being cut from the web which moves continuously through the label application machine by a suitable label cutting mechanism embodied in a label applicator machine. Such labels when cut from the web are held by a vacuum drum, with the adhesive side facing outwards, and from this drum they have to be applied to the bottle necks. The conventional method of applying the leading edge of the label to the bottle neck followed by a spinning of the bottle cannot be adopted in such circumstances.

Also known devices for applying labels to bottle necks are disclosed in U.S. Pat. No. 3,616,092, European Patent Applications Nos. 0135935 and 0078076 and British Pat. No. 1,080,370.

In particular, U.S. Pat. No. 3,616,092 discloses that labels are wrapped around bottle necks after the labels have been applied in flat condition and tangentially to side necks in that the bottles are moved through the machine in a step by step sequence. At a first position, the labels are applied to the bottle necks, and then the bottles are moved to a second position. At the second position, a deflecting mechanism advances and partially applies a label around the bottle neck whereupon the bottle is moved to a further station. At the further station, the label is fully wrapped round the neck by scissor like arms which advance on a sliding member and the movement of the scissor like arms is controlled by a complicated arrangement of springs and labels. Such a machine is particularly complex and is relatively slow in operation insofar as the bottles must move on a step by step pattern.

Various other devices are disclosed in the aforesaid prior patent specifications, but none operates on the principal of the present invention which is to achieve accurate and rapid wrapping of labels around the necks of the bottles.

According to the invention there is provided a machine for applying labels to bottles comprising:

(a) means for moving the bottles in sequence through the machine in sequence, (b) means for applying labels whilst flat individually and tangentially to the bottles, and (c) cam means for wrapping the tangentially applied labels round the bottles characterised in that said cam means comprises a pluralty of assemblies supported by said means for supporting so that the assemblies move in an endless path each adapted to receive a bottle with a label applied tangentially thereto and whilst it moves with the bottles wraps the label therearound and then releases the bottle before moving to a position to receive a further bottle, each of said assemblies comprising arms which are operated by virtue of movement of the assembly along said endless path. Such means may comprise a carousel wheel having pockets in which the bottles are individually located, the arms being operated in sequence with the movement of the bottles by virtue of a further camming arrangement between said arms and another part of the machine.

The two arms of each pair may move differentially insofar as a first arm, the leading arm, which is initially contacted by the bottle and label may be caused to move in advance of the second or trailing arm, initially to effect wrapping of the leading portion of the label around the bottle, followed by actuation of the second arm which is accelerated to a greater extent to effect the wrapping of the trailing portion on the label.

When the machine through which the bottles pass is provided with a vacuum drum for holding individual labels thereto, preferably the leading end of each label is blown away from the drum, and such leading end travels over a plate guide in order to slice the labels individually away from the vacuum drum as such drum rotates. At the same time, the bottle comes into contact tangentially with the central region of the label, and the bottle and the thus applied label travel to the carousel having said cam means for effecting the complete wrapping of the label round the bottle.

The said rollers may be provided with soft flexible outer surfaces for effecting the wiping of the label around a bottle neck, and so as not to damage the labels, or the outer surfaces may simply be defined by rubber rollers. The said rollers will of course be rotatably mounted on the said cam arms.

The carousel will of course be provided with a plurality of pockets so as to receive the bottles in sequence, each pocket being associated with a pair of said camming arms and rollers.

Peferably, the machine has die and anvil means for cutting out the labels from a web of backingless adhesive labels. The adhesive preferably is on the labels, and preferably is of the pressure sensitive type, although a heat sensitive type may be used, in which case it would be desirable to provide a heat activating means within the applicator machinery in order to activate the adhesive before the labels are applied to the bottles.

In practice, a high tack adhesive is used to ensure that the labels will remain tangentially connected to the bottle necks as the bottles move between the location where the labels are attached to the bottles tangentially, and where the labels are finally wrapped completely on the bottle neck.

It will be understood that the invention can be applied to complete wrap around labels or patch labels, and it will also be understood clearly that it is not necessary that the labels be applied to bottles or bottle necks as clearly the principle can be applied in any circumstance where a label is to be wrapped round an article, which may be a box or can, as opposed simply to be stuck on a flat face of the article.

An embodiment of the present invention will now be described, by way of example, with reference to the accompanying drawings, wherein.

Figure 1:
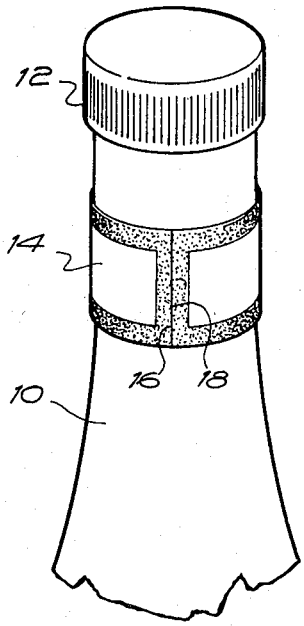
FIG. 1 is a perspective view of a bottle neck.

Referring to the drawings, in FIG. 1 the neck 10 of a bottle, typically a sauce bottle is shown, and the top of the bottle is closed by means of a cap 12. Around the bottle neck is applied a label 14 of the "full wrap" type in that the label ends 16 and 18 meet as shown in FIG. 1.

Figure 2:
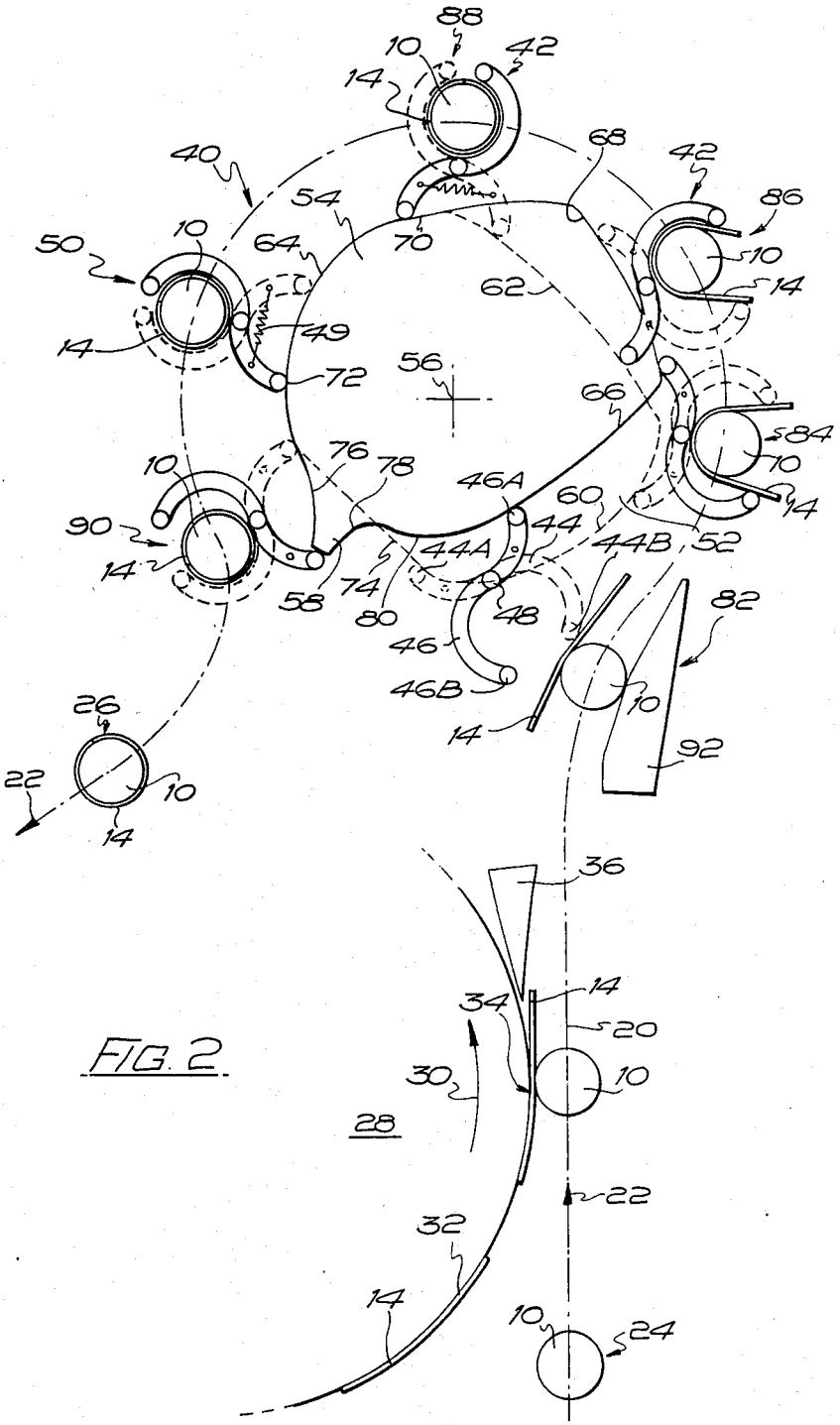
FIG. 2 is a diagrammatic plan showing the mechanism and means for applying the label to the bottle neck as shown in FIG. 1.

The mechanism and means for applying the labels 14 to the bottles 10 is shown in FIG. 2. In FIG. 2, reference numeral 20 represents the path which the bottles take when travelling through the machine, the direction of travel being indicated by arrows 22 the unlabelled bottles enter the application and wrapping device as shown at the region 24, and exit, duly labelled at region 26.

Reference 28 represents a vacuum drum to which the labels 14 are held, the drum continuously rotating in the direction of arrow 30. The labels 14 are held to the drum periphery by means of a vacuum and are separated therefrom at location 34 where the bottles 10 moving in synchronism with the rotation of the drum come into tangential contact with the labels 14 as shown, so that each bottle 10 receives a label 14 so that the label 14 lies tangentially to the bottle neck, and so that the bottle neck contacts the label approximately in its mid region as shown at location 34.

The labels are separated from the drum 28 by means of an air blowing system as described in European Patent Application No. 82 306 505.7, and then are air floated from the drum surface onto a paring knife 36. The bottles 10 thus carrying the labels 14 then move to a wrapping mechanism indicated generally by numeral 40 and the wrapping mechanism 40 comprises a rotary assembly carrying a plurality of wrapping arm assemblies 42 each comprising a pair of scissor like arms 44 and 46 respectively being a leading and trailing arm, and each comprising a roller follower 44A, 46A, and a wrapping roller 44B, and 46B. The arms are fitted together at pivot point 48, and are spring loaded together by means of a tension spring 49 and the portions of the arms carrying rollers 44B and 46B in the closed condition wrap round the bottle neck as shown clearly at location 50 in FIG. 2. The follower rollers 44A and 46A are adapted to engage the outer surfaces of fixed control cams 52 and 54 so that these respective cams control the opening and closing of the arms 44 and 46 during the rotational movement of the assemblies around the centre point 56.

The two cams 52 and 54 are held stationary whilst a ring carrying the assemblies 42 is driven around the pivot point 56, so that the assemblies 42 move in an endless, circular path, and the rollers 44A and 46A remain in contact with the outer peripheries of the cams 52 and 54.

The cam 52 has a lead ramp 58, followed by an arcuate raised cam portion 60 which leads to a trail ramp portion 62 and a lower arcuate portion 64 completes the cam profile.

The cam 54 is provided with a lead ram portion 66 leading to a raised cam portion 68 followed by a trail cam portion 70 leading to a lower arcuate portion 72 and then there is a bead portion 74 having a sharp elevating front 76 and an even sharper tail lowering portion 78, leading to a short lower arcuate portion 80 to complete the cam profile.

As will be understood, as the assemblies 42 are rotated round the cams 52 and 54, so the arms 44 and 46 pivot in sequence and this sequence is in order to effect opening and closing of the arms to permit respective bottles 10 with the labels 14 stuck thereto to be inserted between the arm portions carrying rollers 44B and 46B. The sequence of operations can be understood by examining the conditions of the arms at the respective locations 82, 84, 86, 88 and 90.

At location 82, the arm 44 is engaged upon the elevating track portion 58, and therefore has swung from the open position shown in FIG. 2. At the same time the bottle 10 with applied label 14 moving in path 20 is about to be entered between the arms 44 and 46.

At location 84, the arm 46 has by its follower roller 46A engaging the elevated arcuate portion 68 also pivoted to the open position and the bottle 10 has moved into location between the arms, but the ends of the label 14 engage the wiping rollers 44B and 46B, so that the label in fact takes up a V configuration as shown at location 84.

By the time location 86 has been reached, the arm 44 has commenced closing by virtue of the fact that the follower 44A is engaged on lowering track portion 62, and therefore the appropriate side of the label 14 has been partially wrapped around the bottle neck, and by the time the assembly 42 has reached position 88, both arms 44 and 46 have moved to the closed position as shown at reference 50 in FIG. 2 completing the wrapping of the label around the bottle neck. The assembly travels in the closed position until it reaches location 90 whereat the arm 46 has opened sharply permitting the bottle 10 with the label 14 wrapped therearound to move out of the assembly and to location 26.

The process is of course synchronized in that the bottles move in synchronism with the rotation of the ring carrying assemblies 42 so that high speed and effective labelling can take place.

It will be noticed that there is no requirement for the bottle to be rotated about its own axis during the application of the label in the method as illustrated in FIG. 2.

It will be understood furthermore that the invention is applicable to the labelling of articles other than bottles.

The retention member 92 shown in FIG. 2 is to assist in forcing the bottles into location between the open arms 44 and 46 of each assembly 42.

We claim:

1. A machine for applying labels to bottles comprising:

(a) means for moving the bottles in sequence through the machine;

(b) means for applying labels whilst flat individually and tangentially to the bottles;

(c) a plurality of arm assemblies mounted for continuous movement in an endless path and each defining a pocket to receive a bottle and adapted to wrap a tangentially applied label around a bottle;

(d) said means for moving the bottles in sequence being arranged to feed the bottles individually into the pockets of said arm assemblies in a direction tangentially to said endless path whilst the said assemblies move in the endless path so that the bottles are progressively fed into the pockets and such progressive feeding causes partial wrapping of the labels round te bottles; and (e) cam means co-operating with said arm assemblies to operate same by virtue of the movement of the assemblies around said endless path to complete the wrapping of the labels round the bottles.

2. A machine according to claim 1, characterized in that said arm assemblies (42) each comprise arcuate arms (44, 46) carrying rollers (44B, 46B) at the extremities thereof, said rollers (44B, 46B) being caused to roll round a bottle (10) to apply respective portions of a label (14) extending to each side of where the label contacts the bottle tangentially.

3. A machine according to claim 2, characterized in that said means (40) for moving comprising a carousel wheel (40) having said pockets in which the bottles (10) are individually located, the arm assemblies being operated in sequence with movement of the bottles by virtue of engagement with said cam means.

4. A machine according to claim 3, characterized in that each arm assembly comprises a pair of said arms interconnected such that the two arms (44, 46) of each pair move differently, the leading arm (44) of each pair which is initially contacted by a bottle and label moves in advance of the other or trailing arm (46), initially to effect wrapping of the leading portion of the label (14) around the bottle (10), followed by actuation of the other or trailing arm (46) which is accelerated to a greater extent to effect the wrapping of the trailing portion of the label (14) around the bottle.

5. A machine according to claim 4, characterized in that said rollers (44B, 46B) are provided with soft flexible outer surfaces for effecting the wiping of the label around the bottle, and so as not to damage the labels.

6. A machine according to claim 3, characterized in tht each of said pockets is associated with a pair of said arms (44, 46) and a pair of said rollers (44B, 46B).

7. A machine according to claim 1, characterized in that said means for applying labels includes a vacuum drum (28) for holding individual labels (14) thereto, air blowing means for blowing the leading end of each label away from the drum, and a plate guide (36) over which leading end travels in order to remove the labels individually away from the vacuum drum (28) as such drum rotates and at the same time that the bottle comes into contact tangentially with the central region of the label, such that the bottle and the thus applied label travel to the arm assemblies (42) by said means for moving.

8. A machine according to claim 1, characterized in that the machine has die and anvil means for cutting out the labels from a web of backingless adhesive labels.

* * * * *